United States Patent [19]

Naylor et al.

[11] 4,365,585

[45] Dec. 28, 1982

[54] SPRAYING DEVICES

[75] Inventors: Donald B. Naylor, Southampton; Wladyslaw H. Krywiczanin, Fairoak, both of England

[73] Assignee: British-American Tobacco Company Limited, London, England

[21] Appl. No.: 251,786

[22] Filed: Apr. 7, 1981

Related U.S. Application Data

[63] Continuation of Ser. No. 78,579, Sep. 24, 1979, abandoned.

[30] Foreign Application Priority Data

Oct. 6, 1978 [GB] United Kingdom ..... 39576/78

[51] Int. Cl.[3] ..... B05B 17/00; B05B 7/16; B05B 15/02

[52] U.S. Cl. ..... 118/302; 239/112; 131/309; 427/424; 118/303; 427/212; 427/213

[58] Field of Search ..... 427/421, 220, 213, 212, 427/424; 239/112, 413, 417.5, 433; 131/133 R, 140 B; 118/302, 303

[56] References Cited

U.S. PATENT DOCUMENTS

| | | | |
|---|---|---|---|
| 895,668 | 8/1908 | Newman | 239/433 X |
| 2,667,236 | 1/1954 | Graves | 239/433 X |
| 3,043,366 | 7/1962 | Wentworth | 239/112 X |
| 3,394,888 | 7/1968 | Dasse et al. | 239/417.5 X |
| 3,541,023 | 11/1970 | Cole | 239/413 X |
| 3,545,453 | 12/1970 | Hoffman | 131/133 R |
| 3,732,872 | 5/1973 | Lakritz | 131/133 R |
| 3,876,145 | 4/1975 | Gusmer et al. | 239/112 |

FOREIGN PATENT DOCUMENTS

| | | | |
|---|---|---|---|
| 1162746 | 2/1964 | Fed. Rep. of Germany | 131/133 R |
| 608910 | 9/1948 | United Kingdom | 239/417.5 |
| 1357057 | 6/1974 | United Kingdom . | |

*Primary Examiner*—Shrive P. Beck
*Attorney, Agent, or Firm*—Kane, Dalsimer, Kane, Sullivan and Kurucz

[57] ABSTRACT

A liquid-spraying device, particularly for applying an additive to a moving bed of smoking material. The device includes a body and an elongate narrow unshrouded tubular spray tip carried by the body. First and second ducts are in the body through which the liquid and an atomizing medium respectively can be supplied to the tip. A third duct is provided for supplying a cleaning medium such as air. A jet structure is located remotely from the discharge end of the spray tip, is connected to the third duct and is arranged to direct the cleaning medium along and around the outside of the freely extending tip to the discharge end thereof. The spray tip may be mounted on and extend from a nozzle head connected to the body. The jet structure is provided in the nozzle head, for example, in the form of a plurality of jet orifices equi-angularly spaced around the spray tip. The spray tip and jet can be used in a method of applying a liquid additive to a moving bed of smoking material.

5 Claims, 3 Drawing Figures

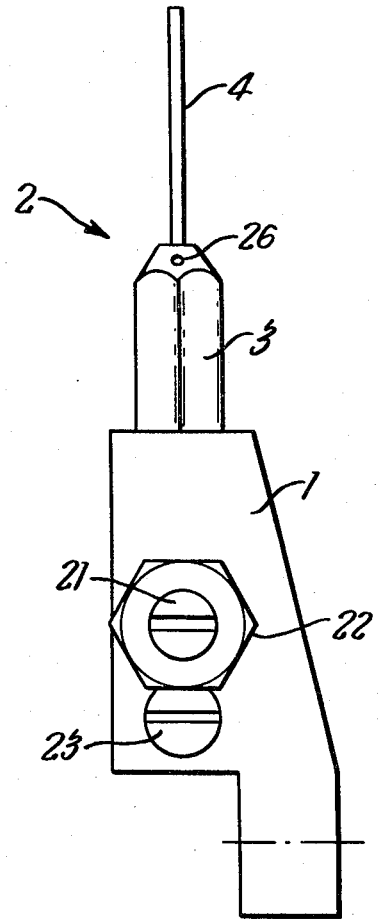
Fig. 1
Fig. 2
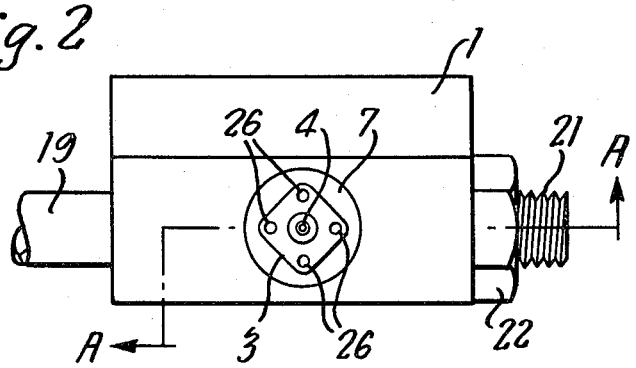

SPRAYING DEVICES

This is a continuation, of application Ser. No. 78,579, filed Sept. 24, 1979 now abandoned.

This invention relates to spraying devices, particularly such for applying additives to tobacco and other materials used in smoking articles. It also relates to a method of applying additives to such materials.

U.K. Patent Specification No. 1,357,057 describes a cigarette making machine provided with means for spraying a tobacco-additive in liquid form onto a bed of tobacco formed on a conveyor band of the machine, the spraying taking place at a position immediately upstream of a station of the machine at which the bed of tobacco is wrapped in a web of cigarette paper. Such means has proved successful with some known cigarette making machines, but problems have been encountered when attempts have been made to use known spraying devices in conjunction with more recently introduced, higher-speed, machines, such as those manufactured by Molins and Arenco-Decoufle under model designations 9 and LOG respectively.

With such higher-speed machines, it has been found that the spraying tip of the additive-spraying device constitutes an obstruction in the space which is bounded above by the bed of tobacco, held on the under side of the conveyor band by suction, and laterally by guide walls. This obstruction has resulted in build-ups of tobacco. Also additive material has built up at the discharge end of the tip. With a menthol-in-alcohol solution, for example, menthol in a crystallised form has been deposited at the end of the tip, pieces of the deposit breaking away intermittently and being incorporated in the tobacco bed. Due to a combination of these two effects, moreover, tobacco particles have adhered to deposits of additive on the tip, the particles then becoming impregnated with further additive and thus attracting further tobacco particles. Such a chain reaction has proceeded until lumps of the resultant agglomeration have broken off and been taken into the tobacco bed. These phenomena have resulted in impairment of machine efficiency and poor quality cigarettes.

The present invention provides an additive-spraying device comprising a body, a narrow, thin-walled, tubular spray tip carried by said body, first and second duct means in said body, via which duct means additive liquid and atomising medium respectively can be supplied to said tip, and third duct means for supplying cleaning medium to jet means arranged to direct the cleaning medium along and around the outside of said tip to the discharge end thereof. The atomising medium will generally be air as may also be the cleaning medium.

Advantageously, the spray tip is mounted on and extends from a nozzle head connected to the body. In this case it is expedient for the jet means to be provided in the nozzle head.

Suitably the jet means takes the form of a number of jet orifices equi-angularly spaced about the spray tip.

Preferably, the tubular tip should have an outside diameter not exceeding 2.0 mm, so as to avoid the above-mentioned problem of obstruction by the tip. The internal diameter of the tip should preferably be not less than 1.0 mm in order to avoid unacceptable resistance to the flow of additive.

The present invention further provides a method of applying an additive to a bed of smoking material, wherein the additive is sprayed onto said bed by a spraying device to which are supplied, under pressure, additive liquid and atomising medium, said device comprising a narrow, thin-walled, tubular spray tip and jet means supplied with cleaning medium under pressure which is directed by said jet means along and around the outside of the spray tip to the discharge end thereof.

Reference will now be made, by way of example, to the accompanying diagrammatic drawings, in which:

FIG. 1 shows an end elevation of a tobacco-additive spraying device;

FIG. 2 shows a plan view of the device of FIG. 1; and

Figure 3:
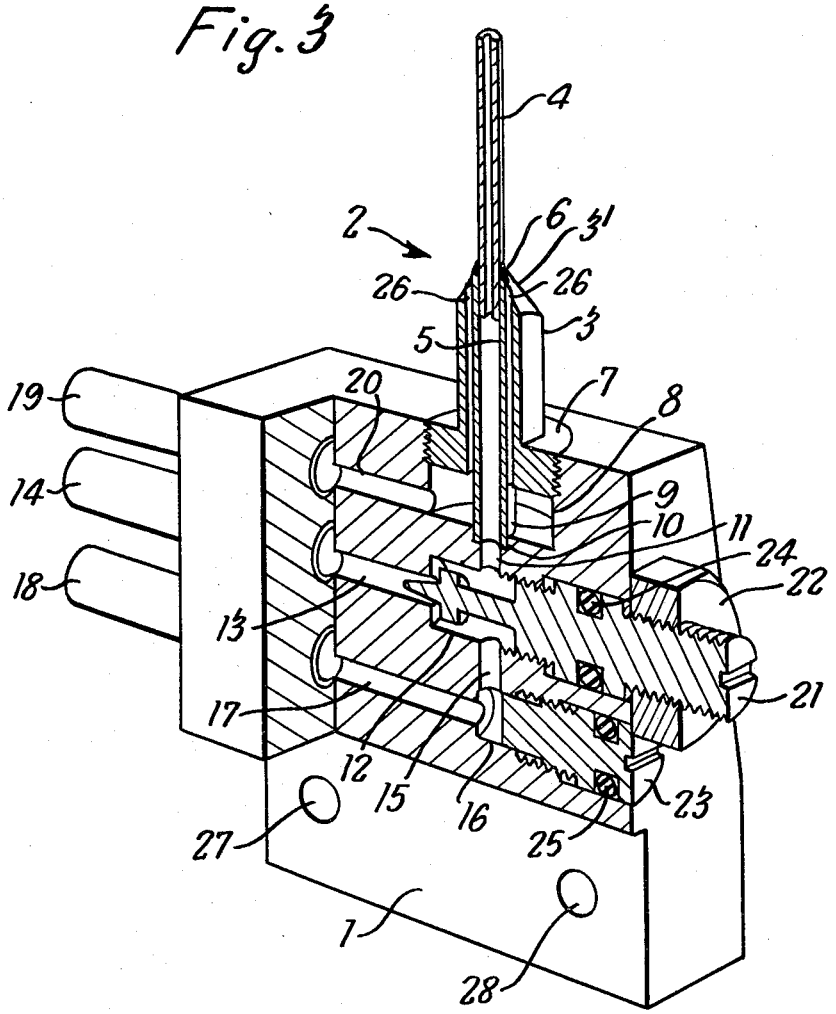
FIG. 3 shows a perspective view of the device, partly cut away on the line A—A of FIG. 2.

The spraying device shown in the drawings comprises a brass body 1 and, extending upwardly of the body 1, a nozzle 2 composed of a brass nozzle head 3, of square external section in the example illustrated, and a stainless steel spray tip 4. The lower part of the tip 4, cut from hypodermic-needle stock having an outside diameter of 1.5 mm and an inside diameter of 1.0 mm, is received in a bore 5 of the nozzle head 3, the tip 4 and the head 3 being secured together at 6 by silver soldering. The portion of the tip 4 extending above the head 3 has a length of 20 mm. A flange portion 7 (FIG. 3) of the head 3 is threadedly received in an upper portion of a wide bore 8 of the body 1. Below the flange portion 7, the head 3 has a downwardly extending tubular portion 9 which is received as a close fit in an upper, widened, portion 10 of a narrow bore 11 of the body 1, which bore 11 extends co-axially downwardly from the bore 8. The nozzle head 3 may thus be screwed into the body 1 so that the lower end of the portion 9 of the head 3 forms a fluid-tight metal-to-metal seal in the portion 10 of the bore 11.

The lower end of the bore 11 opens into a bore 12 extending perpendicularly to the bore 11. From the left hand end of the bore 12, a bore 13 extends to the inner end of a pipe 14 received in the body 1. A bore 15 coaxial with the bore 11 extends downwardly into communication with a bore 16 parallel to the bore 12. A bore 17 extends leftwardly from the bore 16 to the inner end of a pipe 18 received in the body 1. A third pipe 19 is received in the body 1 above the pipe 14 and communicates with the bore 8 via a bore 20 opening at the peripheral wall of the bore 8.

A flow-regulation screw 21 (FIG. 8) with a needle valve and closure shoulder is threadedly received in the bore 12 and is securable in desired axial position relative thereto by a lock nut 22. A headless calibration plug 23 is threadedly received in the bore 16. The nut 22 on the regulation screw 21 overlies a portion of the outer end of the bore 16, preventing the plug 23 from being inadvertently unscrewed. The screw 21 and plug 23 are provided with O-ring seals 24 and 25 respectively.

The nozzle head 3 is provided with four fine bores 26 extending from the under face of the flange portion 7 to a conically sloping upper surface 3', the bores being equi-angularly spaced relative to the tip 4 (FIG. 2). The bores 26 may, for example, have a diameter of 0.75 mm.

Locating holes 27 and 28 extend into a lower end region of the body 1 so that, when the spraying device is mounted on a fixed part (not shown) of a cigarette making machine, pins of the fixed part are received as a close sliding fit in the said holes. The device is held in position on the machine by means of a spring-loaded quick-release latch (not shown). When mounted, the spraying device is so orientated that the tip 4 is inclined in the direction of travel of the tobacco bed at an angle of 20° to the vertical.

In use of the above described device, the pipes 14 and 18 respectively are connected to sources (not shown) of tobacco-additive liquid, such as menthol-in-alcohol solution, and atomising air. By way of example, the air may be under a pressure of 0.6 atmospheres and the solution under a pressure of 1.0 atmospheres. The pipe 19 is connected to a source (also not shown) of cleaning air under a pressure of, for example, 0.3–7.0 atmospheres. The rate of flow of the additive is preselected by adjustment of the flow-regulation screw 21. The atomising air passes along the bores 17 and 15 and meets the additive in the bore 12 to which the additive has passed via the bore 13. The two fluids then pass upwardly together through the bore 11, the bore 5 in the head 3 and finally through the tip 4, from which the additive issues as an atomised spray upwardly onto the bed of tobacco moving above. The discharge end of the tip 4, which is spaced from the under side of the bed by, for example 2–3 mm. Cleaning air from the bores 26 is directed along the outside of the tip 4 to the discharge end thereof. Use on a Molins Model 9 cigarette making machine of a spraying device such as has been described achieved effective additive application free of problems arising from build-up of additive material and/or tobacco at the tip.

To calibrate the flow of additive, the additive is passed through the spraying device without being atomised. This condition is obtained by screwing home the plug 23 to obturate the air-supply bore 17.

Other air-jet means, for example an annular-jet orifice, may be used instead of a number of bores 26 leading to jet orifices.

The above-described spraying device could be incorporated in spraying apparatus which in other respects is substantially as described in Specification No. 1,357,057.

We claim:

1. A liquid-spraying device comprising a body, an elongate narrow unshrouded tubular spray tip carried by the body, first and second duct means in the body, via which duct means the liquid and an atomising medium respectively cab be supplied to the tip, a third duct means for supplying a cleaning medium, jet means located remotely from the discharge end of said spray tip, connected to the third duct means and arranged to direct the cleaning medium along and around the outside of the tip to the discharge end thereof, a nozzle head connected to the body, the spray tip being mounted on and extending from said head, the body having a plurality of superimposed cavities with means for communicating with, respectively from the lowest cavity upwardly, a supply of the atomising medium, a supply of the liquid to be sprayed and a supply of the cleaning medium, the intermediate cavity, which has means for controlling the supply of the liquid and communicates with the spray tip through an axial passage in the nozzle head, while the highest cavity communicates with the jet means through axially disposed passage means provided in the nozzle head around said axial passage.

2. A liquid-spraying device comprising a body, a nozzle head connected to the body, an elongate narrow unshrouded spray tip having an outside diameter of not more than 2.0 mm. carried by the body and being mounted on and extending from said head for spraying onto a recipient bed of particulate material without creating disturbance to that material either directly or as a result of effects of deposition from the liquid, jet means located remotely from the discharge end of the spray tip and arranged to direct a cleaning medium along and around the outside of the tip to the discharge end thereof, the body having first, second and third cavities to which may be supplied, respectively via first, second and third duct means in the body, an atomising medium, the liquid to be sprayed and the cleaning medium, the first cavity being in flow communication with the second cavity, the second cavity being in flow communication with the spray tip via a passage co-axial with the tip, and the third cavity being in flow communication with the jet means via passage means disposed about the co-axial passage.

3. A spraying head according to claim 2, wherein the jet means comprises a plurality of jet orifices equiangularly spaced around the spray tip.

4. Apparatus for spraying a liquid tobacco-additive upon a bed of particulate smoking material, comprising a spraying device according to claim 2 in operative combination with means for producing relative movement, longitudinally of the bed, between said bed and device.

5. Apparatus according to claim 4, wherein the spray tip has an internal diameter of not less than 1.0 mm.

* * * * *